United States Patent [19]

Oguma

[11] Patent Number: 4,485,793

[45] Date of Patent: Dec. 4, 1984

[54] SUPERCHARGER CONTROL SYSTEM FOR AUTOMOBILES

[75] Inventor: Tomio Oguma, Anjo, Japan

[73] Assignee: Aisin Seiki Kabushiki Kaisha, Kariya, Japan

[21] Appl. No.: 382,730

[22] Filed: May 27, 1982

[30] Foreign Application Priority Data

Jun. 5, 1981 [JP] Japan ..... 56-087264

[51] Int. Cl.[3] ..... F02D 23/00

[52] U.S. Cl. ..... 123/559

[58] Field of Search ..... 123/559, 564, 565

[56] References Cited

U.S. PATENT DOCUMENTS 1,630,634 5/1927 Porsche ..... 123/559
1,651,250 11/1927 Brownback ..... 123/559
1,878,210 9/1932 Vincent ..... 123/559

FOREIGN PATENT DOCUMENTS 145433 4/1936 Austria ..... 123/559
155084 11/1938 Austria ..... 123/559
238363 8/1925 United Kingdom ..... 123/564

*Primary Examiner*—Michael Koczo
*Attorney, Agent, or Firm*—Oblon, Fisher, Spivak, McClelland & Maier

[57] ABSTRACT

A supercharger control system for an internal combustion engine equipped with a supercharger to be driven by output torque of the engine and including an electrically operated clutch for transmitting the output torque of the engine to the supercharger upon engagement thereof and for disconnecting the supercharger from the engine upon deenergization thereof. The control system comprises a bypass air duct bypassing the supercharger to provide a bypass air flow routed into the intake manifold of the engine, an electrically operated valve disposed within the bypass air duct to be open during deactivated condition of the supercharger and to be closed in response to activation of the supercharger, and an electric control device for engaging the clutch and closing the valve when high engine output torque is demanded and for disengaging the clutch and opening the valve when low engine output torque is demanded.

4 Claims, 5 Drawing Figures

SUPERCHARGER CONTROL SYSTEM FOR AUTOMOBILES

BACKGROUND OF THE INVENTION

The present invention relates to a supercharger control system for automobiles, and more particularly to a supercharger control system for an internal combustion engine to be driven by output torque of the engine to supercharge the air flow routed into the intake manifold of the engine.

In general, operation of such a supercharger as described above is effective to increase output torque of the engine so as to satisfy acceleration requirement on demand but causes increase of fuel consumption under normal driving conditions of the automobile

SUMMARY OF THE INVENTION

It is, therefore, a primary object of the present invention to provide a supercharger control system which is capable of deactivating the supercharger when low engine output torque is demanded under normal driving conditions and activating the supercharger only when high engine output torque is demanded for acceleration of the automobile.

According to the present invention there is provided a supercharger control system for an internal combustion engine equipped with a supercharger to be driven by output torque of the engine to supercharge the air flow routed into the intake manifold of the engine and including clutch means adapted to the supercharger for transmitting the output torque of the engine to the supercharger upon engagement thereof and for disconnecting the supercharger from the engine upon disengagement thereof. The control system is characterized by provision of a bypass air duct bypassing the supercharger to provide a bypass air flow routed into the intake manifold of the engine, valve means disposed within the bypass air duct to be maintained in its open position during deactivated condition of the supercharger to allow the bypass air flow through the bypass air duct and to be closed in response to activation of the supercharger to interrupt the bypass air flow through the bypass air duct, and control means for engaging the clutch means and closing the valve means when high engine output torque is demanded and for disengaging the clutch means and opening the valve means when low engine output torque is demanded, In the actual practices of the present invention, it is preferable that the control means is arranged to engage the clutch means and close the valve means when the throttle opening angle of the engine is larger than a value related to the rotational speed of the engine on a basis of a predetermined relationship between the throttle opening angle and the rotational speed of the engine and that the control means is further arranged to disengage the clutch means and open the valve means when the throttle opening angle is smaller than the value related to the rotational speed of the engine.

BRIEF DESCRIPTION OF THE DRAWINGS

Additional objects and advantages of the present invention will be more readily apparent from the following detailed description of a preferred embodiment thereof when taken together with the accompanying drawings in which.

DETAILED DESCRIPTION OF THE PREFERRED EMBODIMENT

Figure 1:
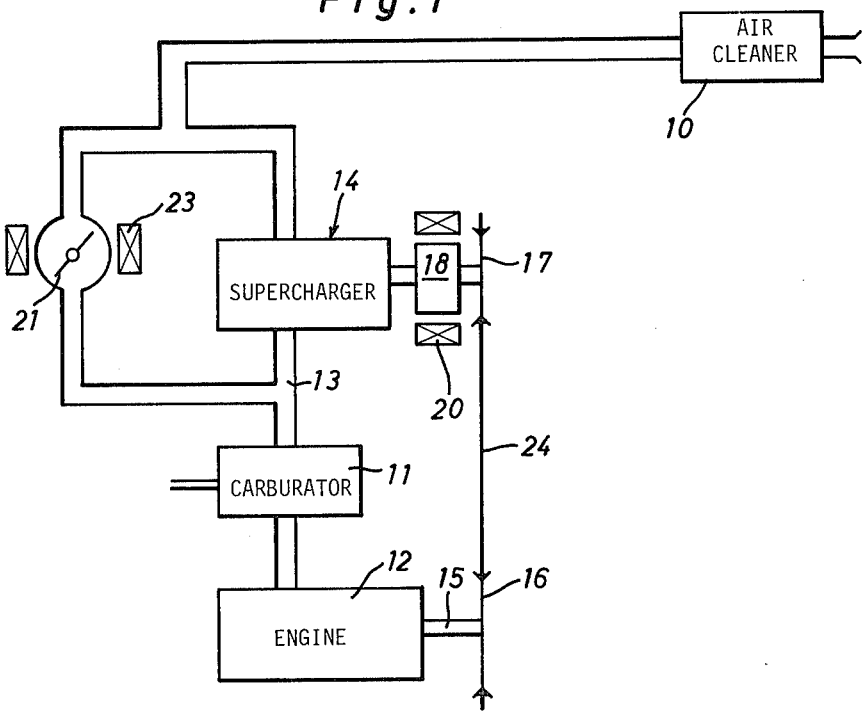
FIG. 1 illustrates a supercharger control system in accordance with the present invention.

Referring now to the drawings, particularly in FIG. 1 there is illustrated a supercharger control system adapted to an internal combustion engine 12, in which a supercharger 14 is disposed within an air duct 13 connecting an air cleaner 10 to the intake manifold of engine 12 through a carburator 11. The supercharger 14 is arranged to be driven by output torque of engine 12 to supercharge the engine 12. The supercharger 14 is equipped with an electromagnetically operated clutch 18 whose input shaft has a driven pulley 17 fixed thereto and whose output shaft is drivingly connected to an input shaft of supercharger 14. An output shaft 15 of engine 12 is fixedly provided thereon with a drive pulley 16 which is connected to the driven pulley 17 by means of an endless belt 24 to transmit the output torque of engine 12 to the input shaft of clutch 18. The electromagnetically operated clutch 18 engages in response to energization of its solenoid winding 20 to transmit the output torque of engine 12 to the supercharger 14 therethrough and disengages in response to deenergization of its solenoid winding 20 to disconnect the supercharger 14 from the engine 12.

A solenoid bypass valve 21 of the normally open type is disposed within a bypass duct 22 bypassing the supercharger 14 and is arranged to be closed in response to energization of its solenoid winding 23 during activation of the supercharger 14 to prevent the supercharged air flow from leakage toward the air cleaner 10 therethrough. During deactivation of the supercharger 14, the solenoid winding 23 is maintained in its deenergized condition to open the valve 21 so as to allow the air flow routed into the intake manifold of engine 12 across bypass duct 22.

Figure 2:
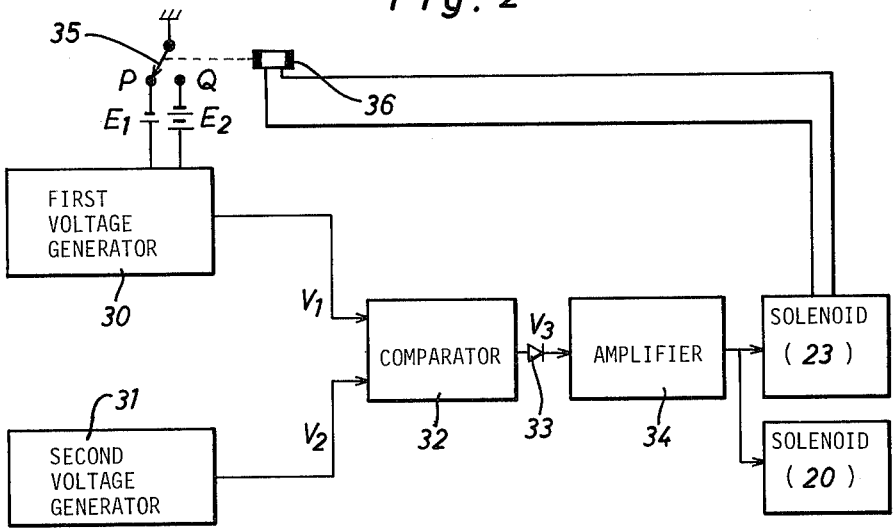
FIG. 2 is a schematic block diagram of an electric control circuit adapted to the control system of FIG. 1.

In FIG. 2 there is illustrated an electric control circuit for controlling an electric power supply to both the solenoid windings 20 and 23 of clutch 18 and valve 21 in accordance with operating conditions of the engine. The electric control circuit includes a first voltage generator 30 which is arranged to be selectively connected to low and high voltage sources $E_1$ and $E_2$ under control of a relay switch 35 as described later. The first voltage generator 30 includes a speed sensor for detecting the actual rotational speed of engine 12 in a usual manner to produce an output signal indicative of the actual rotational speed of engine 12 and a voltage converter which is designed to generate an output voltage $V_1$ therefrom in relation to a value of the output signal from the speed sensor. When connected to the low voltage source $E_1$ the converter in generator 30 generates an output voltage $V_1$ therefrom as shown by a solid line segment A - B' and a dotted line segment B' - C' - D'E' in FIG. 3. In this instance, when the actual rotational speed of engine 12 is in a range between 0–800 r.p.m., the output voltage $V_1$ is maintained at a predetermined positive level $V_a$. When the actual rotational speed of engine 12 is over 800 r.p.m., the output voltage $V_1$ increases in accordance with the increase of rotational speed of engine as shown by the dotted line segment B' - C' - D'E'.

Figure 3:
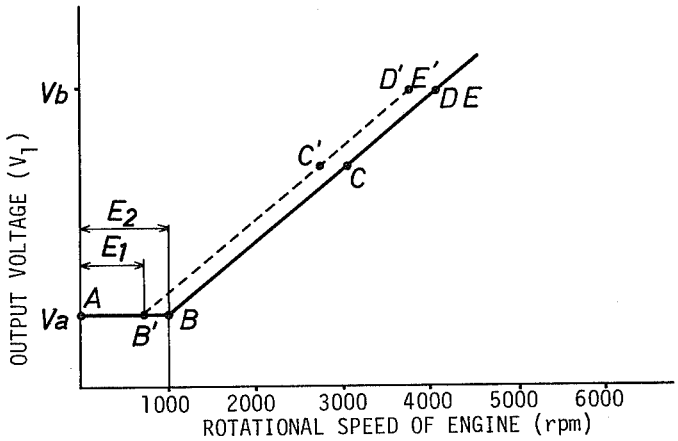
FIG. 3 is a graph illustrating an output voltage in relation to the rotational speed of the engine.

When connected to the high voltage source $E_2$, the converter in generator 30 generates an output voltage $V_1$ therefrom as shown by a solid line segment A - B and a solid segment B - C - DE in FIG. 3. Under this condition, when the actual rotational speed of engine 12 is in a range between 0–1000 r.p.m., the output voltage $V_1$ is maintained at the predetermined positive level $V_a$. When the actual rotational speed of engine 12 is over 1000 r.p.m., the output voltage $V_1$ increases in accordance with the increase of rotational speed of engine 12 as shown by the solid line segment B - C - DE in parallel with the dotted line segment B' - C' - D'E' in FIG. 3.

The electric control circuit further includes a second voltage generator 31 which is provided with a throttle position sensor for detecting the actual opening angle of the engine throttle to produce an output signal indicative of the actual opening angle of the engine throttle. The second voltage generator 31 is further provided with a second voltage converter which is designed to generate an output voltage $V_2$ therefrom in relation to a value of the output signal from the throttle position sensor, as shown by solid line segments A - B - C, C - D, and D - E in FIG. 4. When the throttle opening angle is in a range between 0–approximately 88%, the output voltage $V_2$ increases in accordance with the increase of the throttle opening angle as shown by the solid line segment A - B - C in FIG. 4. When the throttle opening angle exceeds a value of approximately 88–90%, the output voltage $V_2$ sharply increases and is subsequently maintained at a predetermined high level $V_b$. It is further noted that each voltage level at points B, C, D and E in FIG. 4 is indicated to be equal to that in FIG. 3.

In the electric control circuit, a comparator 32 is applied at its negative input terminal with the output voltage $V_1$ from the first voltage generator 30 and at its positive input terminal with the output voltage $V_2$ from the second voltage generator 31. The comparator 32 is designed to generate an output voltage $V_3$ at a positive level only when the level of output voltage $V_2$ is higher than that of output voltage $V_1$. The output voltage $V_3$ is amplified by an amplifier 34, which is connected to the output terminal of comparator 32 through a diode 33, and is applied to both the solenoid windings 20 and 23 to activate the supercharger 14 and to close the bypass valve 21. The relay switch 35 includes a relay coil 36 in connection to the solenoid winding 23 and is arranged to connect in its P position the first voltage generator 30 to the low voltage source $E_1$ in response to deenergization of the relay coil 36 and to connect in its Q position the same to the high voltage source $E_2$ in response to energization of the relay coil 36. From the above description, it will be apparent that when the level of output voltage $V_2$ is lower than that of output voltage $V_1$, the output voltage $V_3$ does not appear at the output terminal of comparator 32.

Figure 4:
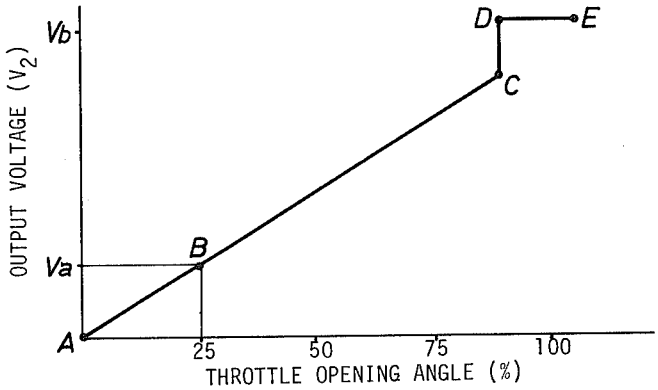
FIG. 4 is a graph illustrating an output voltage in relation to the throttle opening angle of the engine.
Figure 5:
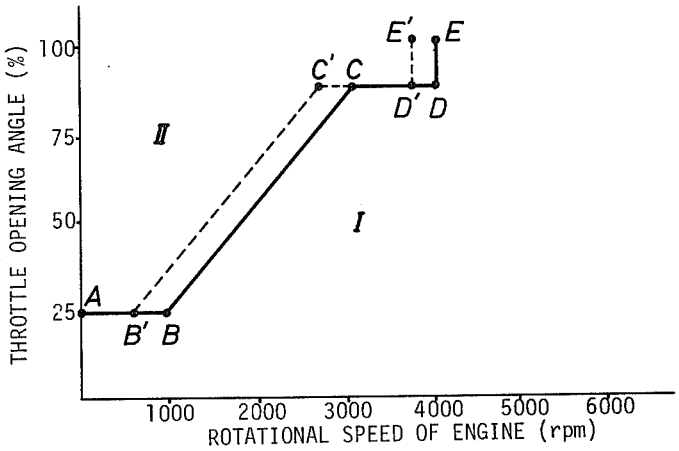
FIG. 5 illustrates a predetermined relationship between the rotational speed and the throttle opening angle of the engine.

In FIG. 5 there is illustrated a relationship between the throttle opening angle and the rotational speed of engine 12 in consideration with the output voltages $V_1$ and $V_2$ by utilizing the characteristic lines in FIGS. 3 and 4. With reference to FIG. 5, it will be understood that when a relationship between the actual throttle opening angle and the actual rotational speed of engine 12 is plotted in a first range indicated by the reference numeral I, the output voltage $V_3$ does not appear at the output terminal of comparator 32. When a relationship between the actual throttle opening angle and the actual rotational speed of engine 12 is plotted in a second range indicated by the reference numeral II, the output voltage $V_3$ appears at the output terminal of comparator 32.

In operation, when low engine output torque is demanded under normal driving conditions of the vehicle, the throttle opening angle is smaller than a value related to the rotational speed of engine 12 to be plotted in the first range I in FIG. 5. Under such operating conditions, the output voltage $V_3$ does not appear at the output terminal of comparator 32 such that both the solenoid windings 20 and 23 are in their deenergized conditions to maintain the supercharger 14 in its deactivated condition and to maintain the bypass valve 21 in its open position. This serves to reduce fuel consumption as small as possible during normal driving conditions of the vehicle. When high engine output torque is demanded for acceleration of the vehicle, the throttle opening angle becomes larger than a value related to the rotational speed of engine 12 to be plotted in the second range II in FIG. 5. Under this operating condition, the output voltage $V_3$ appears at the output terminal of comparator 32 such that both the solenoid windings 20 and 23 are energized to activate the supercharger 14 and to close the bypass valve 21. This results in supercharge of the intake air flow to effect the rapid increase of output torque of engine 12. Simultaneously, the relay switch 35 is switched over from its P position to its Q position to connect the first voltage generator 30 to the high voltage source $E_2$. As a result, the output voltage $V_2$ of first voltage generator 30 is shifted to the output voltage characteristics as shown by the solid line segments in FIG. 3. Thus, a relationship between the throttle opening angle and the rotational speed of engine 12 to be plotted in the second range II in FIG. 5 is expanded to prevent the supercharger 14 from its undesired hunting operation.

Having now fully set forth the preferred embodiment of the concept underlying the present invention, various other embodiments as well as certain variations and modifications of the embodiment herein shown and described will obviously occur to those skilled in the art becoming familiar with said underlying concept. It is to be understood, therefore, that within the scope of the appended claims, the invention may be practiced otherwise than as specifically set forth herein.

What is claimed is:

1. A supercharger control system for an internal combustion engine having an intake manifold comprising:

a supercharger;

air duct means for connecting said supercharger to said internal combustion engine;

clutch means coupling said engine and said supercharger for selectively deactivating said supercharger;

bypass passage means connected to said air duct means at a location between said intake manifold and said supercharger for bypassing said supercharger with a bypass air flow routed into said intake manifold;

valve means disposed within said bypass passage for selective actuation of said bypass air flow in response to the deactivation of said supercharger;

control means connected to said clutch means and said valve means for closing said valve means when high engine output torque is demanded and for disengaging said clutch means and opening said valve means when low engine output torque is demanded;

first signal means connected to said engine for producing a first output voltage indicative of the actual rotational speed of said engine;

second signal means connected to said engine for producing a second output voltage indicative of the throttle opening angle of said engine;

third signal means connected to said first and second signal means for comparing the value of said second output voltage with the value of said first output voltage to generate a third output voltage greater than said first output voltage only when the value of said second voltage is higher than the level of said first output voltage corresponding to a predetermined relationship between the values of said first and second output voltages; and connecting means coupling said third signal means with said clutch means and valve means for engaging said clutch means and closing said valve means in response to said third output voltage.

2. A supercharger control system as claimed in claim 1, wherein;

said clutch means is an electrically operated clutch and said valve means is an electrically operated valve of the normally open type.

3. A supercharger control system as claimed in claim 1, further comprising:

fourth signal means responsive to said third output voltage from said third signal means for shifting the value of said first output voltage to a predetermined lower level.

4. A supercharger control system as claimed in claim 2, further comprising:

a low voltage source means;

a relay switch means coupled to said first signal means and said source means for connecting said first signal means and said low voltage source when the value of said second output voltage is lower than the value of said first output voltage and for connecting said first signal means to a high voltage source in response to said third output voltage from said third signal means.

* * * * *